US012016418B2

(12) United States Patent
Park

(10) Patent No.: US 12,016,418 B2
(45) Date of Patent: Jun. 25, 2024

(54) HELMET ADAPTABLE TO DIFFERENT HEAD SHAPES

(71) Applicant: HJC CORP., Gyeonggi-do (KR)

(72) Inventor: Dae Ki Park, Gyeonggi-do (KR)

(73) Assignee: HJC CORP., Gyeonggi-Do (KR)

( * ) Notice: Subject to any disclaimer, the term of this patent is extended or adjusted under 35 U.S.C. 154(b) by 623 days.

(21) Appl. No.: 17/050,914

(22) PCT Filed: Feb. 12, 2019

(86) PCT No.: PCT/KR2019/001707
§ 371 (c)(1),
(2) Date: Oct. 27, 2020

(87) PCT Pub. No.: WO2019/212133
PCT Pub. Date: Nov. 7, 2019

(65) Prior Publication Data

US 2021/0227917 A1 Jul. 29, 2021

(30) Foreign Application Priority Data

May 2, 2018 (KR) ..... 10-2018-0050627

(51) Int. Cl.
*A42B 3/12* (2006.01)
*A42B 3/06* (2006.01)
*A42B 3/14* (2006.01)

(52) U.S. Cl.
CPC ..... *A42B 3/127* (2013.01); *A42B 3/064* (2013.01); *A42B 3/145* (2013.01); *A42B 3/121* (2013.01)

(58) Field of Classification Search
CPC ..... A42B 3/127; A42B 3/064; A42B 3/145; A42B 3/06; A42B 3/12; A42B 3/125; A42B 3/063
USPC ..... 2/411, 412, 414, 417
See application file for complete search history.

(56) References Cited

U.S. PATENT DOCUMENTS 3,609,764 A * 10/1971 Morgan ..... A42B 3/122 2/414
4,024,586 A * 5/1977 Lamb ..... A42B 3/127 2/909
5,204,998 A * 4/1993 Liu ..... A42B 3/124 2/425
5,765,234 A * 6/1998 Petzl ..... A42B 3/324 2/417

(Continued)

FOREIGN PATENT DOCUMENTS

DE 10218269 A1 11/2003
KR 20-0272406 4/2002

(Continued)

*Primary Examiner* — Jameson D Collier
(74) *Attorney, Agent, or Firm* — DUANE MORRIS LLP; Gregory M. Lefkowitz; Joaquin Hernandez

(57) ABSTRACT

The present invention relates to a helmet adaptable to different head shapes. The helmet of the present invention includes a first absorber 200 arranged in the interior of a shell 100, second absorbers 300 arranged in the interior of the first absorber 200, and regulators 400 arranged between the first absorber 200 and the second absorbers 300. When a force acts on the first absorber 200 or one of the second absorbers 300, the corresponding regulator 400 changes the distance between the first absorber 200 and the second absorber 300.

24 Claims, 13 Drawing Sheets

(56) References Cited

U.S. PATENT DOCUMENTS

| | | | | |
|---|---|---|---|---|
| 8,566,968 | B2 * | 10/2013 | Marzec | A42B 3/064 2/411 |
| 8,955,169 | B2 * | 2/2015 | Weber | A42B 3/125 2/425 |
| 9,332,800 | B2 * | 5/2016 | Brown | A42B 3/124 |
| 9,795,178 | B2 * | 10/2017 | Suddaby | A42B 3/124 |
| 11,259,588 | B2 * | 3/2022 | Young | A42B 3/064 |
| 2010/0186150 | A1 * | 7/2010 | Ferrara | F16F 9/0481 2/412 |
| 2013/0007950 | A1 | 1/2013 | Arai | |
| 2013/0125296 | A1 | 5/2013 | Rabinovitch | |
| 2014/0013491 | A1 * | 1/2014 | Hoshizaki | A42B 3/12 2/411 |
| 2017/0027267 | A1 * | 2/2017 | Morgan | A42B 3/062 |
| 2017/0112220 | A1 * | 4/2017 | Suddaby | A42B 3/283 |
| 2017/0127748 | A1 | 5/2017 | Sethumadhavan et al. | |
| 2017/0360587 | A1 * | 12/2017 | Hinds | A61F 5/0118 |

FOREIGN PATENT DOCUMENTS

| | | |
|---|---|---|
| KR | 20-0293637 | 10/2002 |
| KR | 10-2014-0086070 | 7/2014 |
| KR | 10-2016-0093916 | 8/2016 |
| WO | 9920133 A1 | 4/1999 |

* cited by examiner

HELMET ADAPTABLE TO DIFFERENT HEAD SHAPES

CROSS-REFERENCE TO RELATED APPLICATIONS

This application is a § 371 national stage entry of International Application No. PCT/KR2019/001707, filed on Feb. 12, 2019, which claims priority to South Korean Patent Application No. 10-2018-0050627, filed on May 2, 2018, the entire contents of which are incorporated herein by reference.

TECHNICAL FIELD

The present invention relates to a helmet adaptable to different head shapes.

BACKGROUND ART

There has been an increasing necessity to wear safety helmets to protect the head in leisure and sports activities where high speeds are involved. For example, riders of two-wheeled vehicles are required to wear safety helmets to protect their heads.

A safety helmet disclosed in Patent Document 1 has an openable/closable portion in front of a wearer's face. The wearer can secure his/her front field of view through the front openable/closable portion. A selectively openable/closable shield may be provided in the front openable/closable portion to block wind and dust from entering through the facial portion during riding. The prior art helmet includes a hard shell for safety, a liner for shock absorption, and a pad for improving the tightness between the liner and the wearer's head and the wearability of the helmet. However, it is very nearly impossible to design the liner that fits the shapes of all wearers' heads.

Helmets are usually divided into four sizes: small, medium, large, and extra (X) large. This division is generally based on the head circumference dimensions. The internal shapes of helmets are designed based on dimensions approximating those of standard helmets. However, people have different head shapes (prominent forehead and back, prominent left and right sides, prominent top, and flat top of the head) depending on their race, gender, and individual characteristics despite their identical head circumference. For example, a person who has prominent left and right sides of the head and whose head circumference corresponds to a medium size helmet needs to wear a large size helmet to avoid the application of pressure to the left and right sides of the head. The large size helmet fits the left and right sides of the wearer's head but is loose in portions except the left and right sides of the wearers' head. That is, the helmet is larger than its regular size.

In an attempt to solve the problems associated with size, a helmet is lined with sponge pads in portions larger than the head. However, this attempt incurs an additional cost and fails to achieve perfect tightness and wearability.

PRIOR ART DOCUMENTS

Patent Documents (Patent Document 1) KR10-2014-0086070 A

DETAILED DESCRIPTION OF THE INVENTION

Problems to be Solved by the Invention

The present invention has been made in an effort to solve the problems of the prior art and one aspect of the present invention is directed to a helmet adaptable to different head shapes in which a regulator is arranged between a first absorber and a second absorber in a shell to change the distance between the first absorber and the second absorber so that the internal space for helmet wearing can be deformed.

Means for Solving the Problems

A helmet adaptable to different head shapes according to one embodiment of the present invention includes a first absorber arranged in the interior of a shell, a second absorber arranged in the interior of the first absorber, and a regulator arranged between the first absorber and the second absorber wherein when a force acts on the first absorber or the second absorber, the regulator changes the distance between the first absorber and the second absorber.

In the helmet adaptable to different head shapes, the regulator has a lower modulus of elasticity than the first absorber and the second absorber.

In the helmet adaptable to different head shapes, the regulator is made of a material that is deformable in a direction of the force.

In the helmet adaptable to different head shapes, the regulator is made of a reversibly deformable elastomer.

In the helmet adaptable to different head shapes, the regulator includes a housing having an internal empty space and a fluid accommodated in the empty space of the housing.

In the helmet adaptable to different head shapes, the regulator is made of a sponge.

In the helmet adaptable to different head shapes, the regulator has a predetermined thickness and is deformed in the thickness direction to change the distance between the first absorber and the second absorber when a force acts on the second absorber.

In the helmet adaptable to different head shapes, the first absorber and the second absorber are made of expanded polystyrene (EPS) or expanded polypropylene (EPP).

The helmet adaptable to different head shapes further includes a guide adapted to guide movement of the second absorber relative to the first absorber.

In the helmet adaptable to different head shapes, the guide guides movement of the second absorber in a direction parallel to the direction of a force applied to the second absorber.

In the helmet adaptable to different head shapes, the guide physically fixes the first absorber and the second absorber to prevent the first absorber and the second absorber from being separated from each other.

In the helmet adaptable to different head shapes, the guide is a rod-like pin inserted into a first hole formed in the first absorber, a second hole formed in the regulator, and a third hole formed in the second absorber.

In the helmet adaptable to different head shapes, the first absorber has a depressed portion in which the regulator and the second absorber are arranged.

The helmet adaptable to different head shapes further includes a slide adapted to allow the second absorber to slide relative to the first absorber wherein the slide is disposed on a side wall of the depressed portion and/or a side surface of the second absorber facing the side wall of the depressed portion.

In the helmet adaptable to different head shapes, the slide includes a first sliding part disposed on either the side wall of the depressed portion or the side surface of the second absorber and a second sliding part disposed on the remainder of the side wall of the depressed portion and the side surface of the second absorber.

In the helmet adaptable to different head shapes, the first sliding part has groove and the second sliding part has a protrusion.

In the helmet adaptable to different head shapes, the protrusion is inserted into the groove.

In the helmet adaptable to different head shapes, a sliding member is arranged between the first sliding part and the second sliding part and is bent corresponding to the groove and the protrusion.

In the helmet adaptable to different head shapes, the first sliding part is formed separately from one of the side wall of the depressed portion and the side surface of the second absorber and the second sliding part is formed separately from the remainder of the side wall of the depressed portion and the side surface of the second absorber.

In the helmet adaptable to different head shapes, the slide includes a processed area formed on the side wall of the depressed portion and/or the side surface of the second absorber facing the side wall of the depressed portion to reduce the coefficient of friction between the side wall of the depressed portion and the side surface of the second absorber.

In the helmet adaptable to different head shapes, the side wall of the depressed portion is spaced a distance from the side surface of the second absorber.

In the helmet adaptable to different head shapes, the second absorber is arranged in a portion corresponding to the temple of a wearer's head.

In the helmet adaptable to different head shapes, the second absorber is arranged in a portion corresponding to a wearer's forehead.

In the helmet adaptable to different head shapes, the second absorber is arranged in a portion corresponding to the top of a wearer's head.

In the helmet adaptable to different head shapes, the second absorber is arranged in a portion corresponding to the back of a wearer's head.

In the helmet adaptable to different head shapes, the regulator absorbs external shocks.

The features and advantages of the present invention will become more apparent from the detailed description set forth below with reference to the appended drawings.

Prior to the detailed description of the invention, it should be understood that the terms and words used in the specification and claims are not to be construed as having common and dictionary meanings, but are construed as having meanings and concepts corresponding to the spirit of the invention in view of the principle that the inventor can define properly the concept of the terms and words in order to describe his/her invention with the best method.

Effects of the Invention

According to the present invention, the regulator arranged between the first absorber and the second absorber in the shell changes the distance between the first absorber and the second absorber. With this arrangement, the overall relative location between the first and second absorbers as liners is changed, and as a result, the internal space for helmet wearing can be deformed such that the helmet is adapted to different wearers' head shapes to effectively prevent the wearer from feeling inconvenienced.

Due to its inherent elasticity, the regulator arranged between the first absorber and the second absorber is deformable in the thickness direction to more effectively absorb shocks.

BEST MODE FOR CARRYING OUT THE INVENTION

Figure 1:
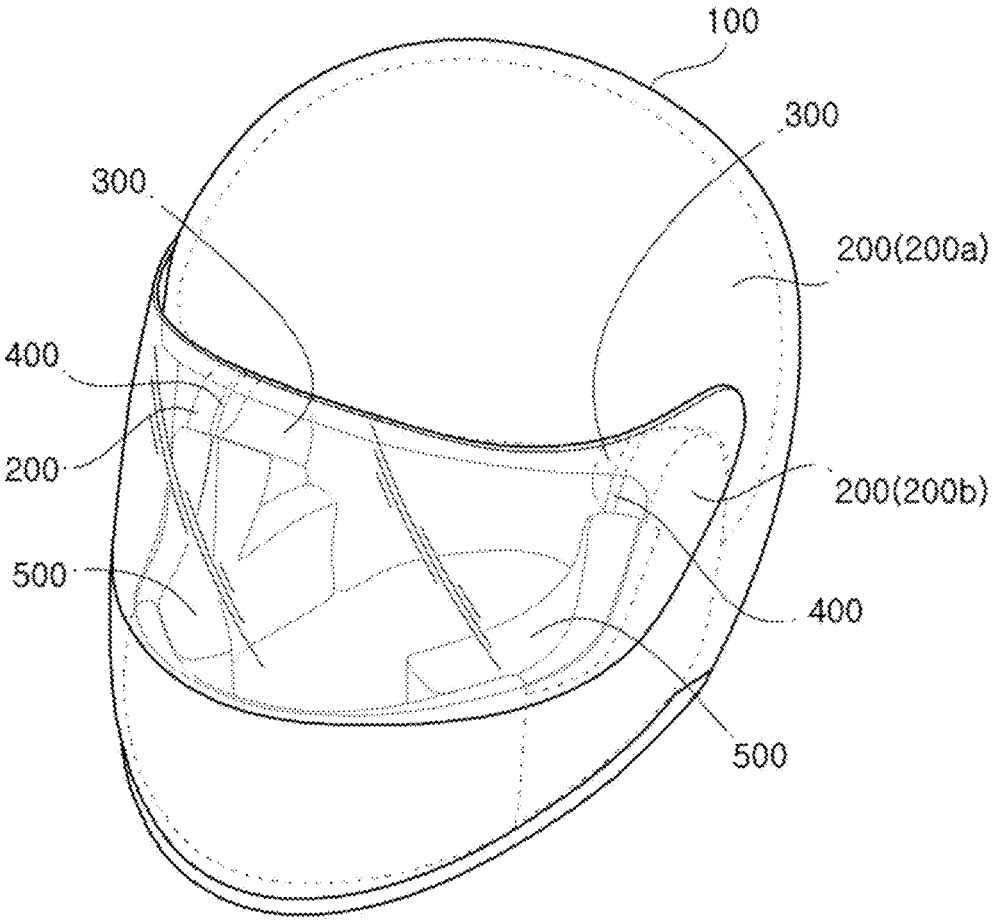
FIG. 1 is a perspective view of a helmet adaptable to different head shapes according to one embodiment of the present invention.

The objects, certain advantages, and novel features of the present invention will become more apparent from the following detailed description and preferred embodiments when taken in conjunction with the accompanying drawings. It should be noted that, wherever possible, the same elements are denoted by the same reference numerals even though they are depicted in different drawings. Although the terms "first", "second", etc. may be used herein to describe various elements, these elements should not be limited by these terms. These terms are only used to distinguish one element from another. In the description of the present invention, certain detailed explanations of related art are omitted when it is deemed that they may unnecessarily obscure the essence of the invention.

Preferred embodiments of the present invention will now be described in detail with reference to the accompanying drawings.

Figure 2:
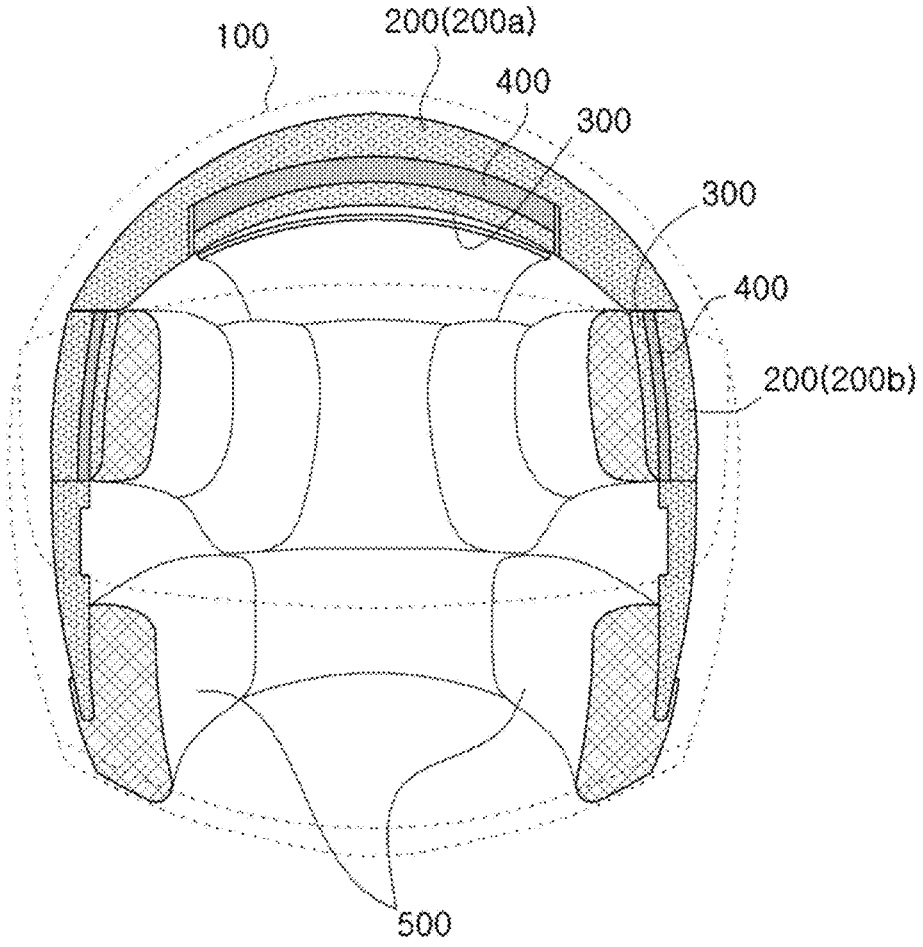
FIG. 2 is a cross-sectional view of the helmet of FIG. 1.
Figure 3:
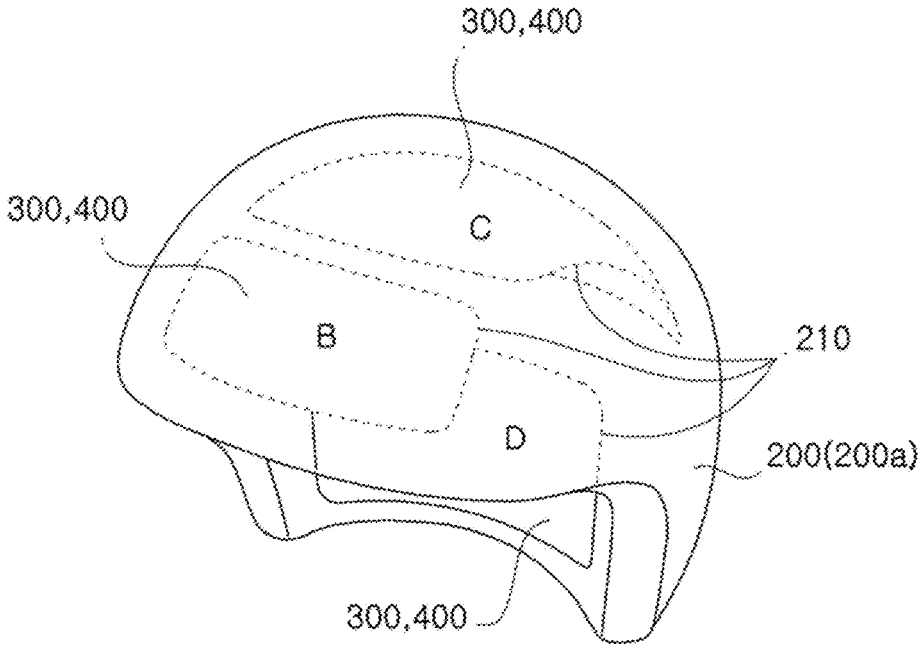
FIG. 3 is an exploded perspective view of a helmet adaptable to different head shapes according to one embodiment of the present invention in which regulators are arranged between first and second absorbers.
Figure 3:
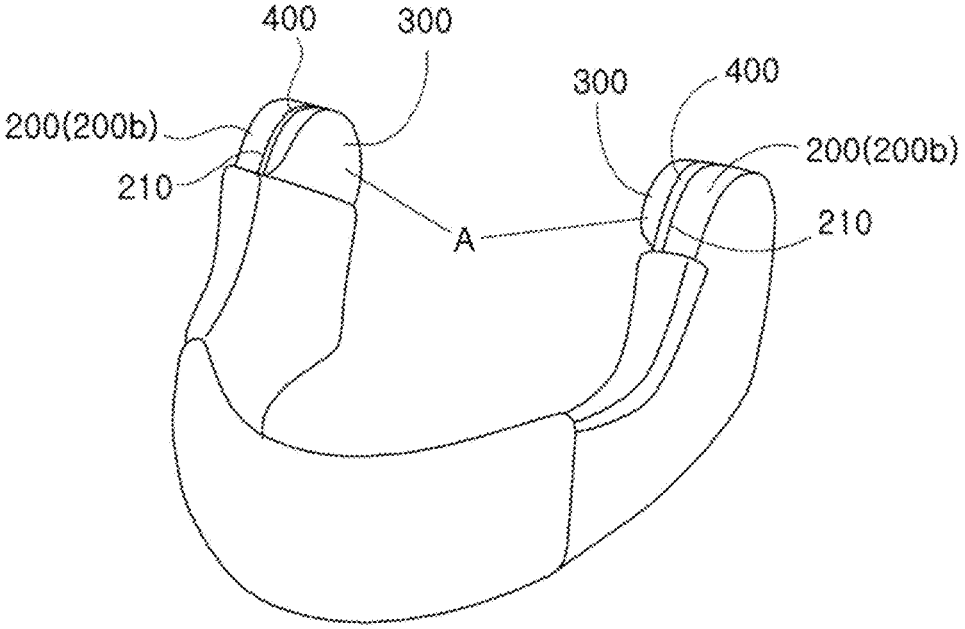
Figure 4A:
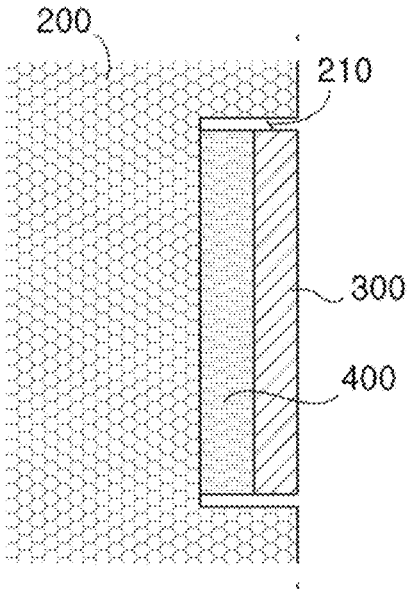
FIGS. 4A and 4B are partial cross-sectional views of a helmet adaptable to different head shapes according to one embodiment of the present invention in which a regulator is arranged between first and second absorbers.
Figure 4B:
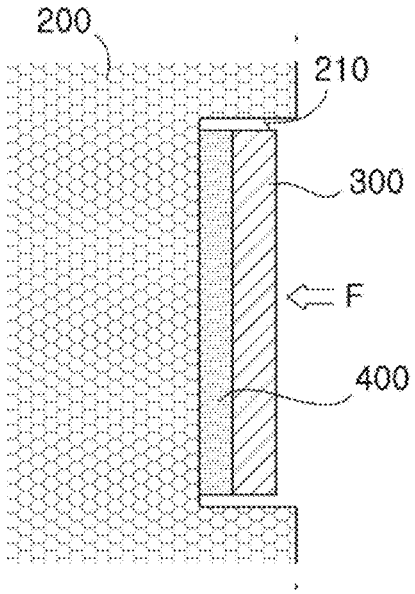

FIG. 1 is a perspective view of a helmet adaptable to different head shapes according to one embodiment of the present invention, FIG. 2 is a cross-sectional view of the helmet, FIG. 3 is an exploded perspective view of the helmet in which regulators are arranged between first and second absorbers, and FIGS. 4A and 4B are partial cross-sectional views of the helmet in which a regulator is arranged between first and second absorbers.

As illustrated in FIGS. 1 to 4, the helmet includes a first absorber 200 arranged in the interior of a shell 100, second absorbers 300 arranged in the interior of the first absorber 200, and regulators 400 arranged between the first absorber 200 and the second absorbers 300 wherein when a force acts on the first absorber 200 or one of the second absorbers 300, the corresponding regulator 400 changes the distance between the first absorber 200 and the second absorber 300.

The helmet essentially includes a shell 100, a first absorber 200, second absorbers 300, and pads 500, as illustrated in FIGS. 1 and 2. The shell 100 serves to ensure wearer's safety due to its high strength. The first and second absorbers 200 and 300, commonly called liners, are arranged in the interior of the shell 100 to absorb shocks applied to the shell 100. The pads 500 serve to improve the tightness between the first and second absorbers 200 and 300 and the wearer's head and the wearability of the helmet.

The first absorber 200 arranged in the interior of the shell 100 has a predetermined thickness and, together with the second absorbers 300, can absorb shocks. The first absorber 200 has a shape corresponding to that of the shell 100 as a whole. The outer lateral surface of the first absorber 200 may be in contact with the shell 100. Specifically, the first absorber 200 consists of a first part 200*a* surrounding the upper portion of the wearer's head and a second part 200*b* surrounding the wearer's chin (see FIG. 3). The modulus of elasticity of the first absorber 200 is high compared to that of the regulators 400, which will be described in detail below. The material for the first absorber 200 is not particularly limited and may be, for example, expanded polystyrene (EPS) or expanded polypropylene (EPP). The first absorber 200 may have depressed portions 210 formed in the thickness direction on its inner surface (opposite to the surface in contact with the shell 100) (see FIG. 4A). The regulators 400 and the second absorbers 300 may be arranged in this order in the depressed portions 210.

The second absorbers 300 (see FIG. 3) arranged in the interior of the first absorber 200 have predetermined thicknesses and, together with the first absorber 200, can absorb shocks. Here, the second absorbers 300 may be arranged in predetermined portions of the first absorber 200. For example, the second absorbers 300 may be arranged in direct contact with the inner surface of the first absorber 200. Alternatively, the second absorbers 300 may be arranged in the depressed portions 210 formed on the inner surface of the first absorber 200 (FIG. 4A). The modulus of elasticity of the second absorbers 300 is high compared to that of the regulators 400, which will be described in detail below. The material for the second absorbers 300 is not particularly limited and may be, for example, expanded polystyrene (EPS) or expanded polypropylene (EPP). The second absorbers 300 may be arranged at locations corresponding to predetermined portions of the wearer's head. The second absorbers 300 may be arranged in portions corresponding to the temples A, forehead B, top C, and back D of the wearer's head, as exemplified in FIG. 3. Accordingly, the depressed portions 210 of the first absorber 200, in which the second absorbers 300 are arranged, may be formed in portions corresponding to the temples A, forehead B, top C, and back D of the wearer's head, like the second absorbers 300.

When a force acts on the first absorber 200 or one of the second absorbers 300, the corresponding regulator 400 serves to change the distance between the first absorber 200 and the second absorber 300. Here, the regulators 400 are arranged between the first absorber 200 and the second absorbers 300. Specifically, each of the regulators 400 may be in the form of a plate with a predetermined thickness. As illustrated in FIGS. 4A and 4B, when a force F acts on the first absorber 200 or the second absorber 300, the regulator 400 is deformed in the direction (thickness direction) of the force F, with the result that the distance between the first absorber 200 and the second absorber 300 can be changed. The regulator 400 has a lower modulus of elasticity than the first absorber 200 and the second absorber 300. Thus, when the force F acts on the first absorber 200 or the second absorber 300, the strain of the regulator 400 may be much higher than that of the first absorber 200 or the second absorber 300. As a consequence, the force F acting on the first absorber 200 or the second absorber 300 substantially deforms the regulator 400 only, causing a change in the distance between the first absorber 200 and the second absorber 300.

Figure 5A:
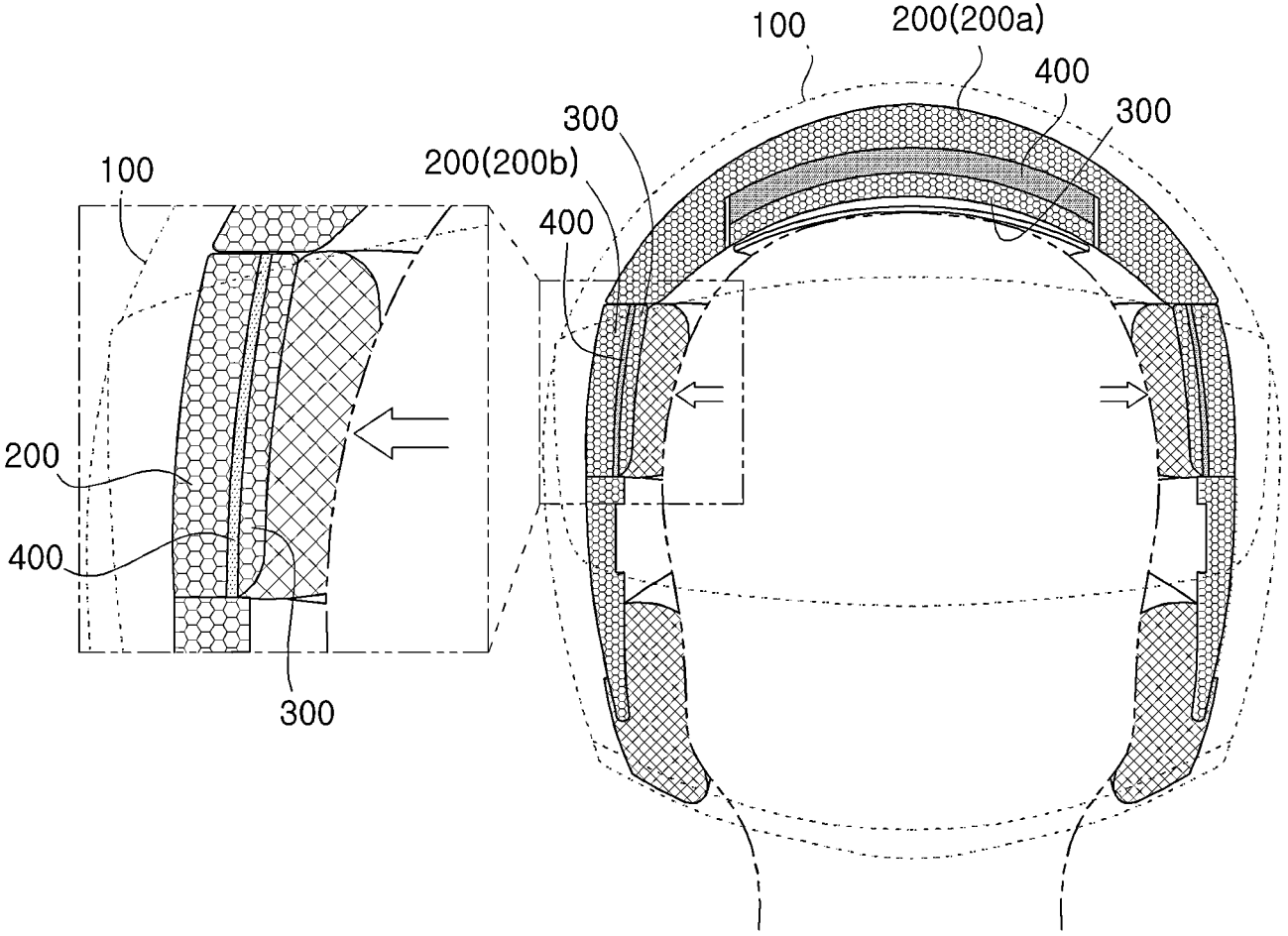
FIGS. 5A and 5B are cross-sectional views illustrating the adaptation of a helmet according to one embodiment of the present invention to different head shapes.
Figure 5B:
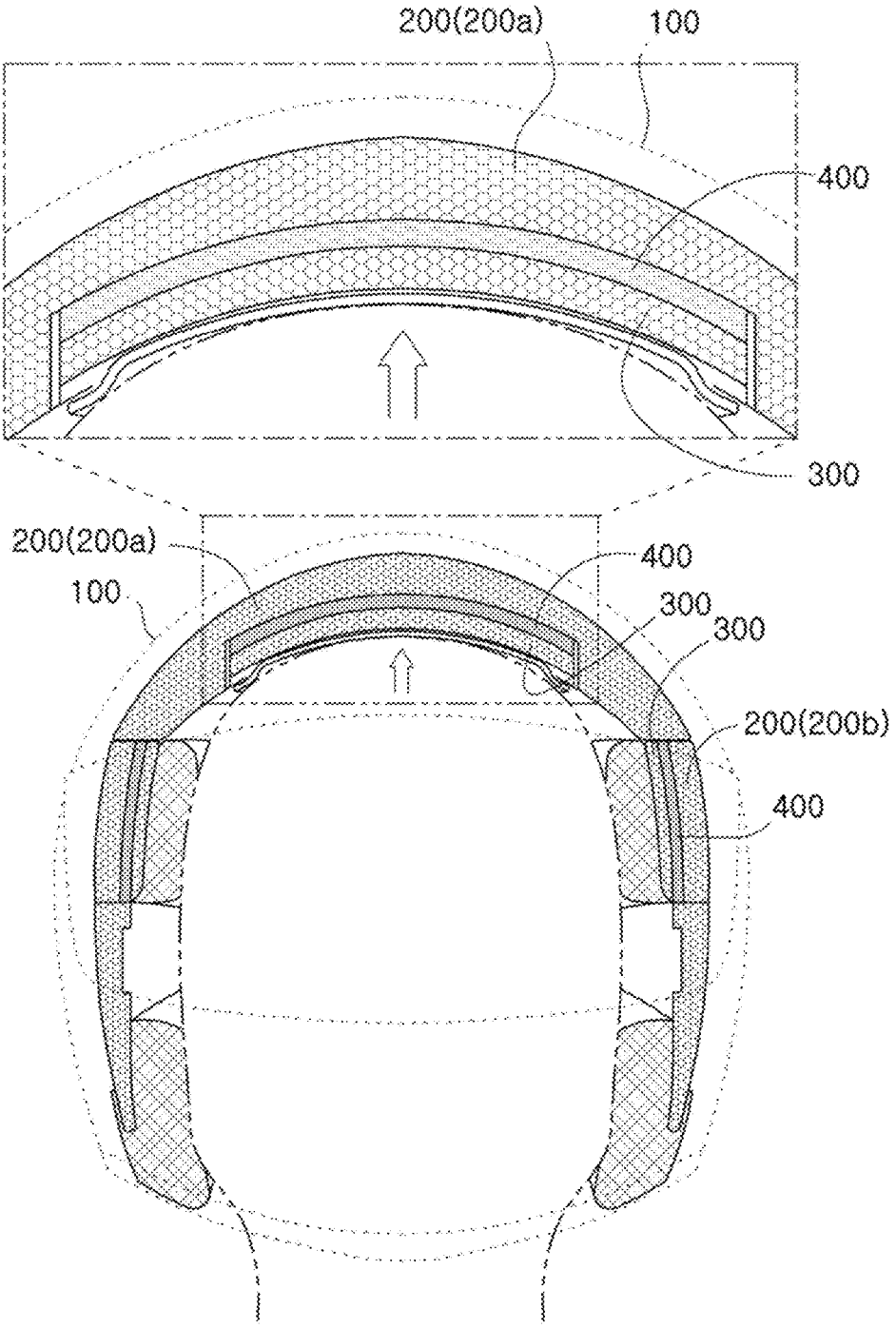

For example, when one or more predetermined portions of the wearer's head are especially more prominent, as illustrated in FIGS. 5A and 5B, forces act on the second absorbers 300 arranged in portions corresponding to the predetermined portions of the wearer's head in the direction toward the first absorber 200. That is, the second absorbers 300 are pressurized in the direction toward the first absorber 200. At this time, only the regulators 400 are substantially compressed so that the distances between the first absorber 200 and the second absorbers 300 can be reduced. The compression of the regulators 400 to reduce the distances between the first absorber 200 and the second absorbers 300 enables the accommodation of the especially more prominent portions of the wearer's head to prevent the wearer from feeling inconvenienced.

Specifically, when the temples of the wearer's head are more prominent, as illustrated in FIG. 5A, the regulators 400 arranged in portions corresponding to the temples of the wearer's head are compressed, and as a result, the second absorbers 300 move toward the first absorber 200 so that the more prominent temples of the wearer's head can be accommodated.

When the top of the wearer's head is more prominent, as illustrated in FIG. 5B, the regulator 400 arranged in a portion corresponding to the top of the wearer's head is compressed, and as a result, the second absorber 300 moves toward the first absorber 200 so that the more prominent top of the wearer's head can be accommodated.

In conclusion, the arrangement of the regulators 400 between the first absorber 200 and the second absorbers 300 changes the overall relative locations between the first and second absorbers (liners) 200 and 300, and as a result, the internal space for helmet wearing is deformed such that the helmet is adapted to different wearers' head shapes.

Figure 6:
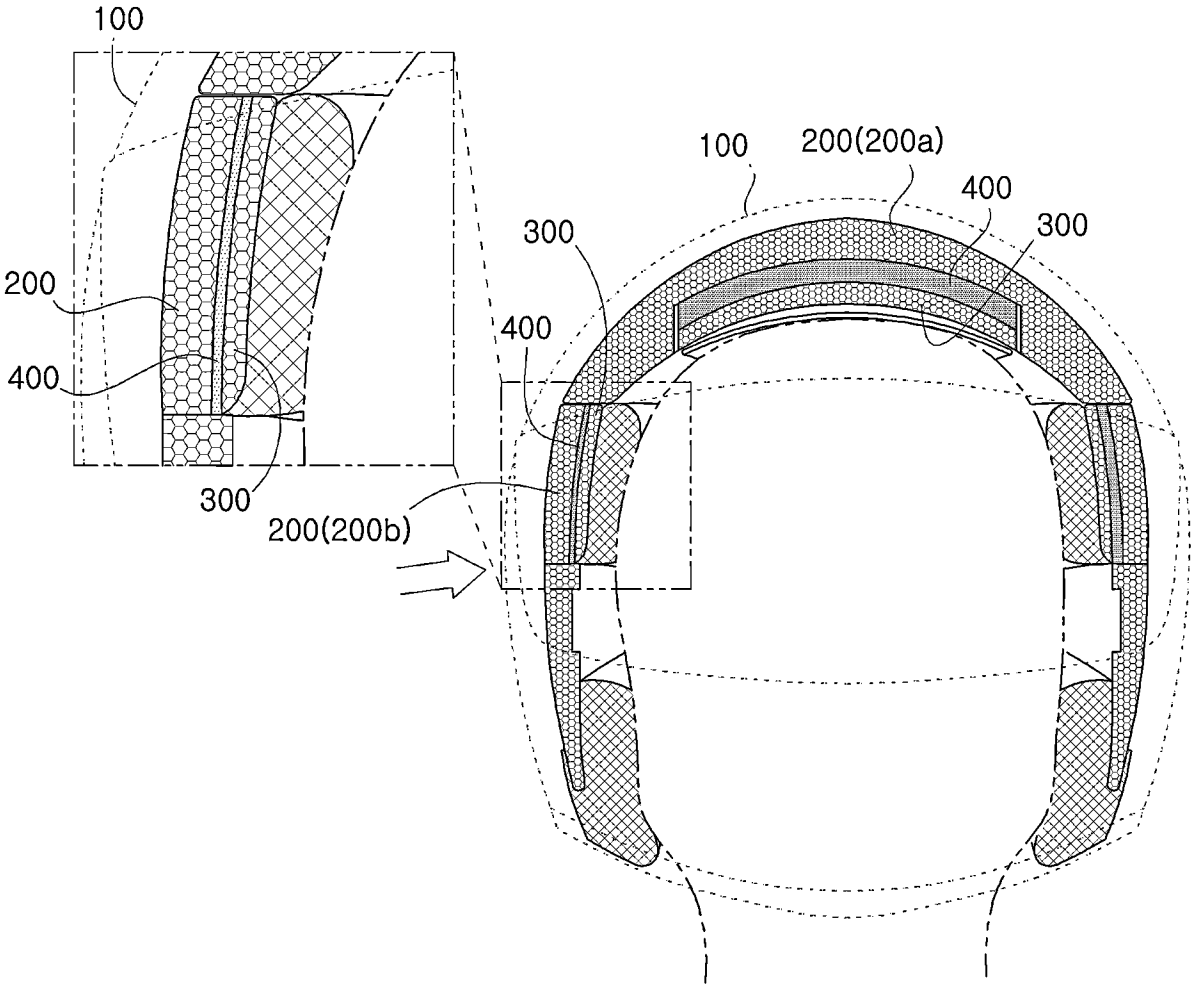
FIG. 6 is a cross-sectional view illustrating the shock absorption of a helmet adaptable to different head shapes according to one embodiment of the present invention.

As illustrated in FIG. 6, when an external shock is applied in the direction indicated by the arrow, a force acts on the first absorber 200 in the direction toward the second absorber 300, that is, the first absorber 200 is pressurized in the direction toward the second absorber 300. Also in this case, the regulator 400 is compressed so that the external impact can be prevented from being delivered to the wearer. That is, since the regulator 400 is deformable in the thickness direction due to its inherent elasticity, the arrangement of the regulator 400 between the first absorber 200 and the second absorber 300 enables more effective absorption of the external impact.

The regulator 400 may be arranged corresponding to the second absorber 300 (see FIG. 4A). Specifically, the regulator 400 and the second absorber 300 are arranged in the depressed portion 210 formed on the inner surface of the first absorber 200. When the second absorber 300 is arranged at a location corresponding to a predetermined portion of the wearer's head, the regulator 400 may also be arranged at the location corresponding to the predetermined portion of the wearer's head. When the second absorbers 300 are arranged in portions corresponding to the temples A, forehead B, top C, and back D of the wearer's head, as exemplified in FIG. 3, the regulators 400 may also be arranged in the portions corresponding to the temples A, forehead B, top C, and back D of the wearer's head.

Figure 7A:
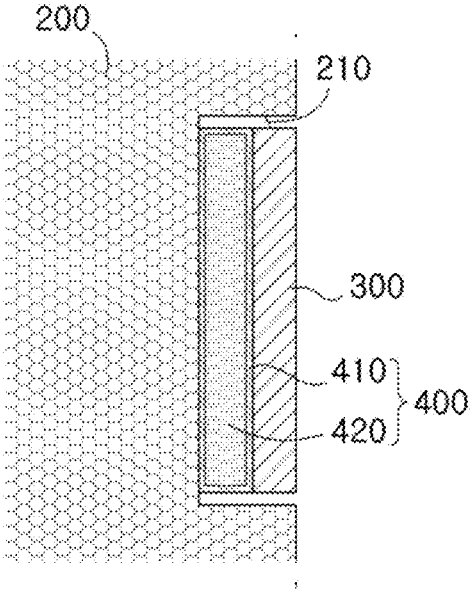
FIGS. 7A and 7B are partial cross-sectional views of a helmet adaptable to different head shapes according to one embodiment of the present invention in which a regulator is arranged between first and second absorbers.
Figure 7B:
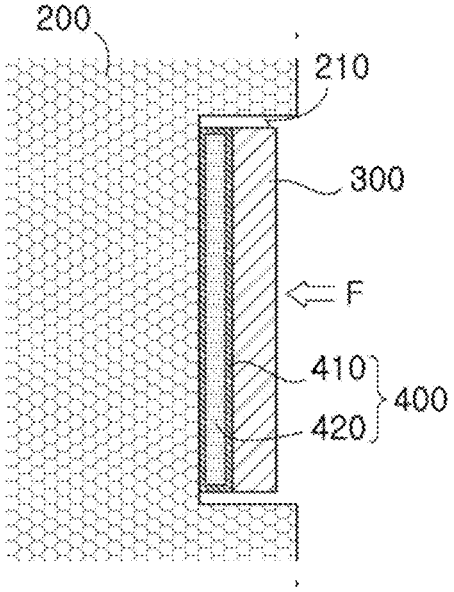

Any material that has a lower modulus of elasticity than the first and second absorbers 200 and 300 may be used without particular limitation for the regulators 400. For example, the regulators 400 may be made of a reversibly deformable elastomer. More specifically, the regulators 400 may be made of sponges. Alternatively, each of the regulators 400 may include a housing 410 having an internal empty space and a fluid 420 accommodated in the empty space of the housing 410, as illustrated in FIGS. 7A and 7B. In this case, when a force acts on the first absorber 200 or the second absorber 300, the fluid 420 is compressed, and as a result, the distance between the first absorber 200 and the second absorber 300 can be reduced.

In the embodiment, although the second absorbers 300 and the regulators 400 are provided in plural, the scope of the present invention is not necessarily limited thereto. The present invention can be embodied with a single second absorber 300 and regulator 400.

MODE FOR CARRYING OUT THE INVENTION

Figure 8A:
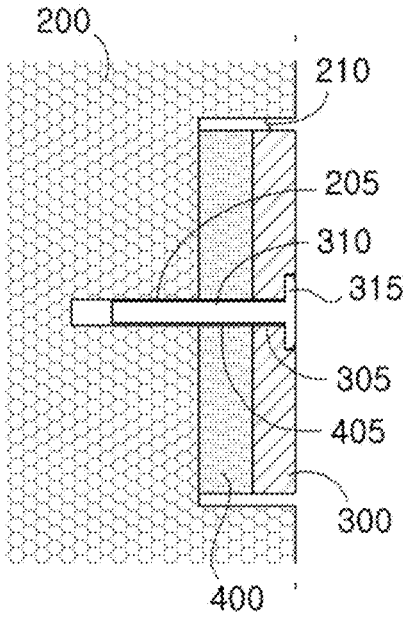
FIGS. 8A and 8B are partial cross-sectional views of a helmet adaptable to different head shapes according to one embodiment of the present invention in which a guide is further provided.
Figure 8B:
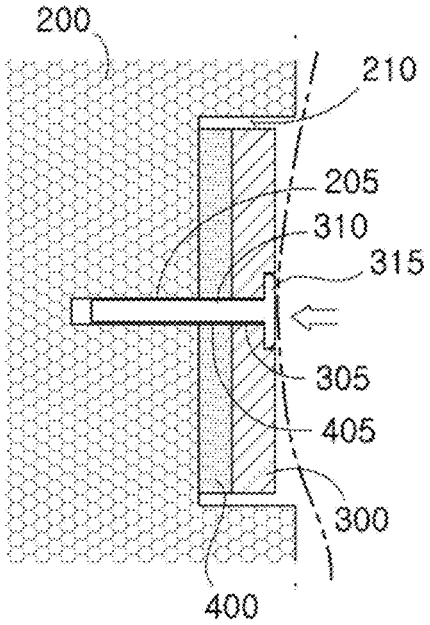

As illustrated in FIGS. 8A and 8B, a guide is provided to guide movement of the second absorber 300 relative to the first absorber 200. Basically, the guide guides movement of the second absorber 300 in a direction parallel to the direction of a force applied to the second absorber 300. The guide may be a rod-like pin 310. The rod-like pin 310 may be inserted into a first hole 205 formed in the first absorber 200, a second hole 405 formed in the regulator 400, and a third hole 305 formed in the second absorber 300. One end (head) of the pin 310 may be fixed to the second absorber 300 and the other end of the pin 10 may slide within the first hole 205 of the first absorber 200 when the second absorber 300 moves relative to the first absorber 200. Since the pin 310 slides within the first hole 205 of the first absorber 200, the pin 310 ensures stable guiding of the second absorber 300 when the second absorber 300 moves relative to the first absorber 200.

By the one end (head 315) of the pin 310 fixed to the second absorber 300, the guide physically fixes the first absorber 200 and the second absorber 300 to prevent the first absorber 200 and the second absorber 300 from being separated from each other.

Figure 9:
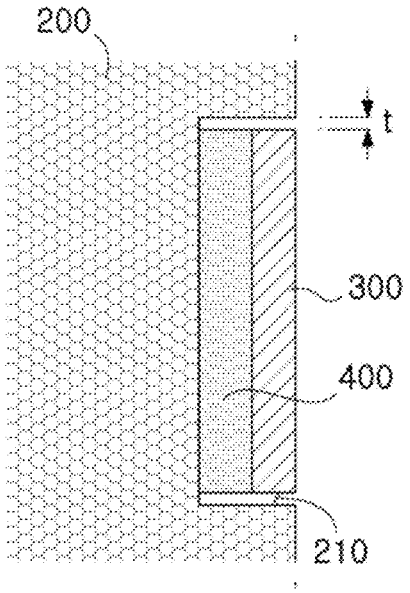
FIG. 9 is a partial cross-sectional view of a helmet adaptable to different head shapes according to one embodiment of the present invention in which a regulator is arranged between first and second absorbers.

As illustrated in FIG. 9, when the second absorber 300 is arranged in the depressed portion 210 formed in the first absorber 200, the side wall of the depressed portion 210 may be spaced a distance (t) from the side surface of the second absorber 300 such that the second absorber 300 is readily movable relative to the first absorber 200.

Figure 10A:
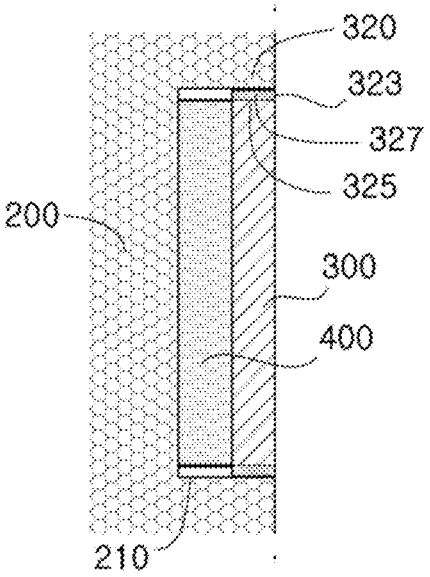
FIGS. 10A and 10B are partial cross-sectional views of a helmet adaptable to different head shapes according to one embodiment of the present invention in which slides are further provided.
Figure 10B:
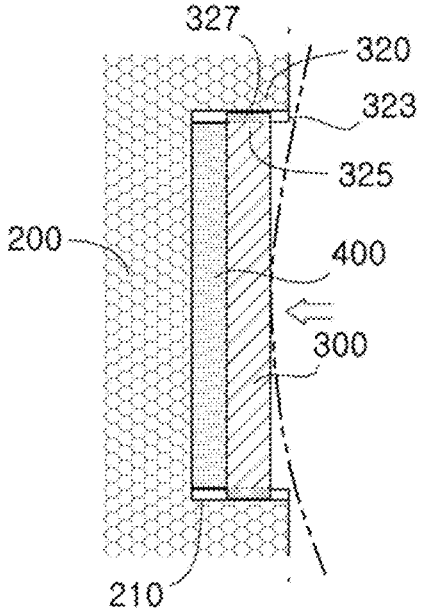
Figure 11:
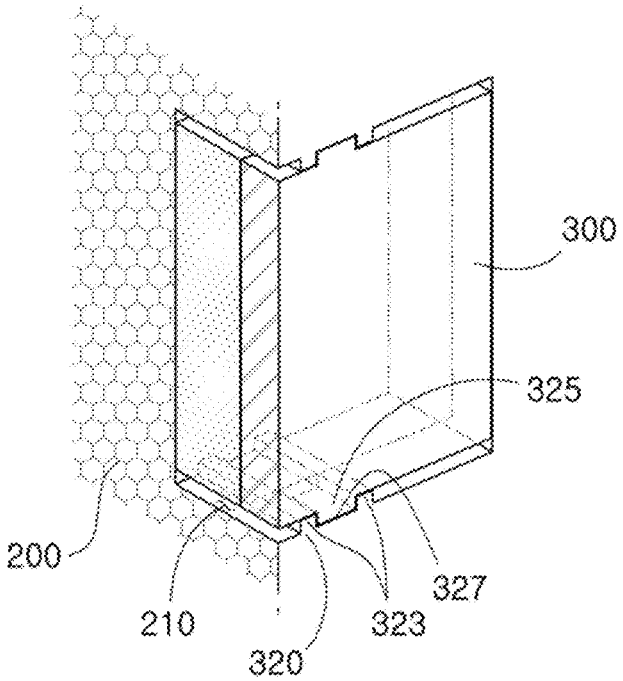
FIG. 11 is a partial perspective view of a helmet adaptable to different head shapes according to one embodiment of the present invention in which slides are further provided.

In the case where the second absorber 300 is arranged in the depressed portion 210 formed in the first absorber 200, a slide may be provided to allow the second absorber 300 to slide relative to the first absorber 200, as illustrated in FIGS. 10A, 10B and 11. Here, the slide may be disposed on the side wall of the depressed portion and/or the side surface of the second absorber facing the side wall of the depressed portion. For example, the slide may include a first sliding part 320 disposed on either the side wall of the depressed portion 210 and the side surface of the second absorber 300 and a second sliding part 325 disposed on the remainder of the side wall of the depressed portion 210 and the side surface of the second absorber 300. The structures of the first and second sliding parts 320 and 325 are not particularly limited, but the first sliding part 320 has groove 323 and the second sliding part 325 has a protrusion 327. The protrusion 327 is movably inserted into the groove 323 (see FIGS. 10A and 10B) such that the second absorber 300 is readily slidable relative to the first absorber 200.

Figure 12:
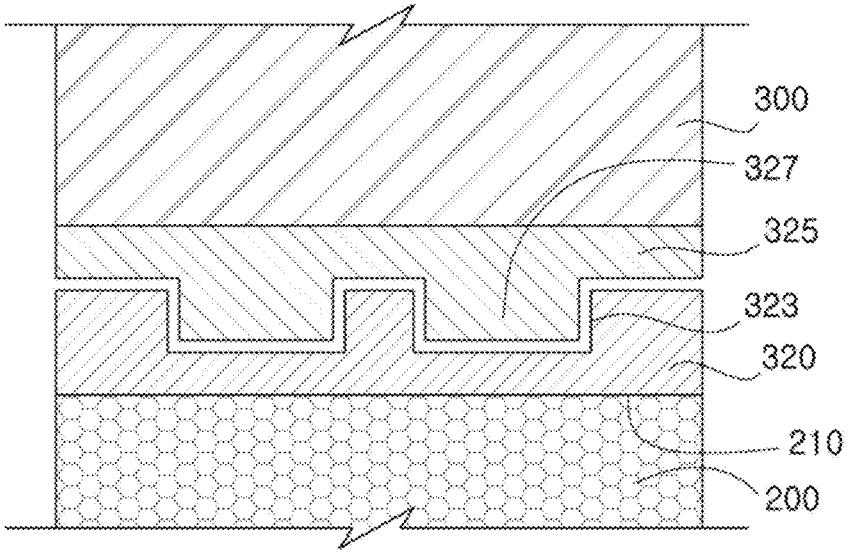
FIG. 12 is a partial cross-sectional view illustrating an alternative embodiment of the helmet of FIG. 11 in which first and second sliding parts are formed.

The first sliding part 320 having the groove 323 and the second sliding part 325 having the protrusion 327 may be integrally formed with the side wall of the depressed portion 210 or the side surface of the second absorber 300, but the structure of the slide is not necessarily limited thereto. As exemplified in FIG. 12, the first sliding part 320 may be formed separately from one of the side wall of the depressed portion 210 and the side surface of the second absorber 300 and the second sliding part 325 may be formed separately from the remainder of the side wall of the depressed portion 210 and the side surface of the second absorber 300.

Figure 13:
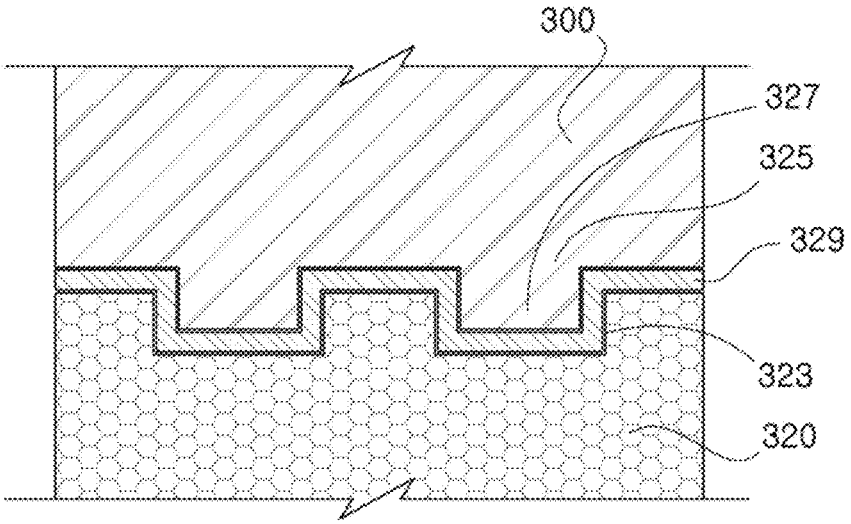
FIG. 13 is a partial cross-sectional view illustrating an alternative embodiment of the helmet of FIG. 11 in which sliding members are further provided.

In addition, as illustrated in FIG. 13, a sliding member 329 may be arranged between the first sliding part 320 and the second sliding part 325. The sliding member 329 is bent corresponding to the groove 323 and the protrusion 327 such that the movement of the second absorber 300 relative to the first absorber 200 can be stably induced.

Figure 14A:
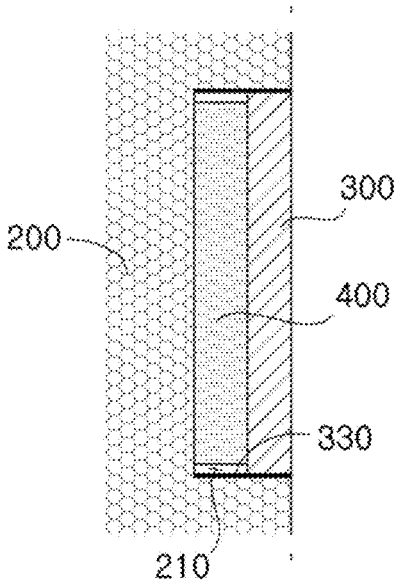
FIGS. 14A and 14B are partial cross-sectional views of a helmet adaptable to different head shapes according to one embodiment of the present invention in which processed areas are further provided.
Figure 14B:
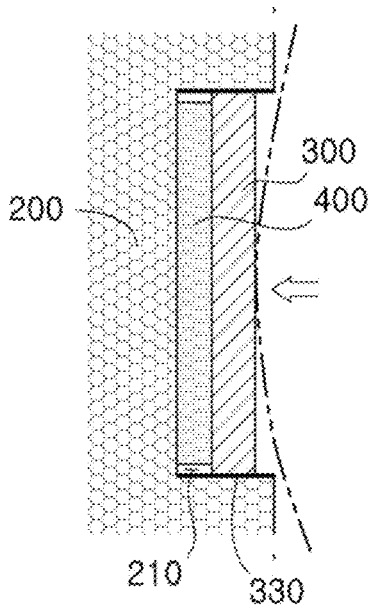

As illustrated in FIGS. 14A and 14B, the slide may include a processed area 330 formed on the side wall of the depressed portion 210 and/or the side surface of the second absorber 300 facing the side wall of the depressed portion 210 to reduce the coefficient of friction between the side wall of the depressed portion 210 and the side surface of the second absorber 300. If the side wall of the depressed portion 210 comes into contact with the side surface of the second absorber 300, the second absorber 300 is not readily slidable relative to the first absorber 200 by the frictional force acting between the side wall of the depressed portion 210 and the side surface of the second absorber 300. To avoid this, the processed area 330 is formed on the side wall of the depressed portion 210 and/or the side surface of the second absorber 300 facing the side wall of the depressed portion 210 to reduce the coefficient of friction between the side wall of the depressed portion 210 and the side surface of the second absorber 300. For example, the formation of the processed area 330 on the side wall of the depressed portion 210 can minimize the frictional force between the side surface of the second absorber 300 moving in contact with the processed area 330 formed on the side wall of the depressed portion 210 and the side wall of the depressed portion 210 to ensure easy sliding of the second absorber 300 relative to the first absorber 200.

The guide and the slide are merely illustrative and are not limited to the above structures and various modifications can be made thereto. For example, the guide and the slide may be formed simultaneously.

The present invention has been described in detail with reference to its specific embodiments. These embodiments are provided for illustrative purposes and are not intended to limit the invention. Those skilled in the art will appreciate that various modifications and improvements are possible, without departing from the scope and spirit of the invention. Simple modifications and changes of the present invention belong to the scope of the present invention, and the specific scope of the present invention will be clearly defined by the appended claims.

[Explanation of reference numerals]

| | |
|---|---|
| 100: Shell | 200: First absorber |
| 200a: First part | 200b: Second part |
| 205: First hole | 210: Depressed portion |
| 300: Second absorber | 305: Third hole |
| 310: Pin | 315: Head |
| 320: First sliding part | 323: Groove |
| 325: Second sliding part | 327: Protrusion |
| 329: Sliding member | 330: Processed area |
| 400: Regulator | 410: Housing |
| 420: Fluid | 405: Second hole |
| 500: Pad | |

The invention claimed is:

1. A helmet adaptable to different head shapes, the helmet comprising a first absorber arranged in an interior of a shell, a second absorber arranged in an interior of the first absorber, and a regulator arranged between the first absorber and the second absorber, wherein when a force acts on the first absorber or the second absorber, the regulator changes the distance between the first absorber and the second absorber, wherein the second absorber is arranged at locations adapted to correspond to predetermined portions of a wearer's head, and wherein the first absorber has a depressed portion in which the regulator and the second absorber are arranged, wherein the regulator has a lower modulus of elasticity than the first absorber and the second absorber.

2. The helmet according to claim 1, wherein the regulator is made of a material that is deformable in a direction of the force.

3. The helmet according to claim 1, wherein the regulator is made of a reversibly deformable elastomer.

4. The helmet according to claim 1, wherein the regulator comprises a housing having an internal empty space and a fluid accommodated in the empty space of the housing.

5. The helmet according to claim 1, wherein the regulator is made of a sponge.

6. The helmet according to claim 1, wherein the regulator has a predetermined thickness and is deformed in the thickness direction to change the distance between the first absorber and the second absorber when the force acts on the second absorber.

7. The helmet according to claim 1, wherein the first absorber and the second absorber are made of expanded polystyrene (EPS) or expanded polypropylene (EPP).

8. The helmet according to claim 1, further comprising a guide adapted to guide movement of the second absorber relative to the first absorber.

9. The helmet according to claim 8, wherein the guide is adapted to guide movement of the second absorber in a direction parallel to the direction of the force, when the force is applied to the second absorber.

10. The helmet according to claim 8, wherein the guide physically fixes the first absorber and the second absorber to prevent the first absorber and the second absorber from being separated from each other.

11. The helmet according to claim 8, wherein the guide is a pin inserted into a first hole formed in the first absorber, a second hole formed in the regulator, and a third hole formed in the second absorber.

12. The helmet according to claim 1, further comprising a slide adapted to allow the second absorber to slide relative to the first absorber wherein the slide is disposed on a side wall of the depressed portion and/or a side surface of the second absorber facing the side wall of the depressed portion.

13. The helmet according to claim 12, wherein the slide comprises a first sliding part disposed on either the side wall of the depressed portion or the side surface of the second absorber and a second sliding part disposed on the remainder of the side wall of the depressed portion and the side surface of the second absorber.

14. The helmet according to claim 13, wherein the first sliding part has a groove and the second sliding part has a protrusion.

15. The helmet according to claim 14, wherein the protrusion is inserted into the groove.

16. The helmet according to claim 14, wherein a sliding member is arranged between the first sliding part and the second sliding part and is bent corresponding to the groove and the protrusion.

17. The helmet according to claim 13, wherein the first sliding part is formed separately from one of the side wall of the depressed portion and the side surface of the second absorber and the second sliding part is formed separately from the remainder of the side wall of the depressed portion and the side surface of the second absorber.

18. The helmet according to claim 12, wherein the slide comprises a processed area formed on the side wall of the depressed portion and/or the side surface of the second absorber facing the side wall of the depressed portion to reduce the coefficient of friction between the side wall of the depressed portion and the side surface of the second absorber.

19. The helmet according to claim 1, wherein a side wall of the depressed portion is spaced a distance from a side surface of the second absorber.

20. The helmet according to claim 1, wherein the second absorber is arranged in a portion adapted to correspond to a temple of the wearer's head.

21. The helmet according to claim 1, wherein the second absorber is arranged in a portion adapted to correspond to the wearer's forehead.

22. The helmet according to claim 1, wherein the second absorber is arranged in a portion adapted to correspond to the top of the wearer's head.

23. The helmet according to claim 1, wherein the second absorber is arranged in a portion adapted to correspond to the back of the wearer's head.

24. The helmet according to claim 1, wherein the regulator is adapted to absorb external shocks.

* * * * *